US006393250B1

(12) United States Patent
Tsukida et al.

(10) Patent No.: US 6,393,250 B1
(45) **Date of Patent: *May 21, 2002**

(54) CLEANING APPARATUS AND IMAGE FORMING APPARATUS

(75) Inventors: Shinichi Tsukida, Yono; Jun Suzuki; Yoichiro Maebashi, both of Numazu; Kimitaka Ichinose, Susono, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/979,325

(22) Filed: Nov. 26, 1997

(30) Foreign Application Priority Data

Nov. 29, 1996 (JP) ..... 8-335006

(51) Int. Cl.[7] ..... G03G 21/00
(52) U.S. Cl. ..... 399/350
(58) Field of Search ..... 399/101, 350, 399/159; 430/109, 111, 125

(56) References Cited

U.S. PATENT DOCUMENTS 4,699,865 A * 10/1987 Mitsuhashi ..... 430/101
5,084,735 A 1/1992 Rimai
5,187,526 A 2/1993 Zaretsky
5,204,034 A 4/1993 Sasame et al.
5,328,792 A * 7/1994 Shigemori et al. ..... 430/106.6
5,646,718 A * 7/1997 Suwa et al. ..... 399/350
5,648,842 A * 7/1997 Sekine et al.
5,712,073 A * 1/1998 Katada et al. ..... 430/110
5,774,771 A * 6/1998 Kukimoto et al. ..... 399/223

FOREIGN PATENT DOCUMENTS

JP 61-279864 * 12/1986
JP 03-290670 * 12/1991
JP 05-241376 * 9/1993
JP 06-148926 * 5/1994
JP 08-087125 * 4/1996
JP 08-220871 * 8/1996

* cited by examiner

*Primary Examiner*—Robert Beatty
(74) *Attorney, Agent, or Firm*—Fitzpatrick, Cella, Harper & Scinto

(57) ABSTRACT

A cleaning apparatus for use in an image forming apparatus removes toner, including spherical toner particles, from an image bearing member for bearing a toner image for use in an image forming apparatus. The toner to be removed is a one-component toner having a shape coefficient SF1 of 100 to 120. The apparatus has blade-shaped elastic member rubbing a surface of the image bearing member for removing the toner and is urged against a surface of the image bearing member with a line pressure of 55 to 95 g·f/cm. The elastic blade is formed so that a thickness of a portion, supported by a support member, of the elastic blade is larger than a thickness of a free end of the elastic blade.

27 Claims, 10 Drawing Sheets

$$SF1 = \frac{(MXLNG)^2}{AREA} \times \frac{\pi}{4} \times 100$$

$$SF2 = \frac{(PERI)^2}{AREA} \times \frac{\pi}{4} \times 100$$

CLEANING APPARATUS AND IMAGE FORMING APPARATUS

BACKGROUND OF THE INVENTION

1. Field of the Invention

The present invention relates to an apparatus for effectively removing spherical toner particles from an image bearing member, and an image forming apparatus of electrophotographic type. More particularly, it relates to an image forming apparatus including a cleaning means having an elastic blade for removing spherical toner particles in a rubbing fashion.

2. Related Background Art

In conventional image forming apparatuses of an telectrophotographic type, as a cleaning means for cleaning a photosensitive drum, a cleaning means 102 having an elastic blade 105 as shown in FIG. 14 is known. Such a cleaning means has widely been used because of simple construction and cheapness.

The cleaning means 102 comprises a waste toner container 103, a support member 104 attached to a surface of the container opposed to a photosensitive drum 101, an elastic blade 105 supported by the support member 104, and a toner collecting sheet 106 attached to the waste toner container 103 below the elastic blade 105.

The elastic blade 105 is formed from polyurethane rubber. A tip end of the elastic blade 105 is urged against a surface of the photosensitive drum 101 (rotated in a direction shown by the arrow in FIG. 14) from a direction (counter direction) opposite to the rotational direction of the photosensitive drum.

In conventional image forming apparatuses using toner manufactured by a crushing method, an urging pressure (abut pressure) of the elastic blade 105 against the photosensitive drum 101 was selected to be about 25 g·f/cm at the minimum. However, as recent color image forming apparatuses have been progressed, a non-magnetic toner manufactured by polymerization has been used as a one-component developer.

The non-magnetic toner manufactured by polymerization (i.e., polymerized toner) includes substantially spherical toner particles, and low soft substance such as wax may be added to such toner. By adding the low soft substance to the polymerized toner, oil coating in a fixing device which was conventionally effected to prevent offset can be omitted, and, even when an image is printed on an OHP sheet, oil can be prevented from adhering to the OHP sheet.

On the other hand, it is well-known that it is difficult to scrape and remove the polymerized toner from the surface of the photosensitive drum 101 by means of the elastic blade (cleaning blade) 105 of the cleaning means 102. It is considered that the reason is that the tip end of the cleaning blade 105 urged against the surface of the photosensitive drum 101 is vibrated due to the rotation of the photosensitive drum, and the polymerized toner comprising spherical toner particles is apt to pass through a small gap between the tip end of the cleaning blade and the surface of the photosensitive drum created due to such vibration.

SUMMARY OF THE INVENTION

An object of the present invention is to provide a cleaning apparatus and an image forming apparatus using such a cleaning apparatus, in which spherical toner particles such as polymerized toner can be removed from an image bearing member such as a photosensitive drum, without occurring poor cleaning.

To achieve the above object, according to the present invention relating to a cleaning apparatus to remove toner from an image bearing member for bearing a toner image, which the toner to be removed is a one-component toner having a shape coefficient SF1 of 100 to 120, and a blade-shaped elastic member rubbing a surface of the image bearing member is used for removing the toner, and the elastic member is urged against the surface of the image bearing member with line pressure of 55 to 95 g·f/cm.

Further, the present invention provides an image forming apparatus for forming a toner image on an image bearing member and for transferring the toner image onto a transfer material, comprising a toner image forming means for forming a toner image with one-component toner having a shape coefficient SF1 of 100 to 120 on the moving image bearing member, a transfer means for transferring the toner image formed on the image bearing member onto a transfer material, and a blade-shaped cleaning means disposed at a downstream side of the transfer means in a moving direction of the image bearing member to be urged against a surface of the image bearing member with a line pressure of 55 to 95 g·f/cm to scrape and remove residual toner remaining on the image bearing member after transferring.

DETAILED DESCRIPTION OF THE PREFERRED EMBODIMENTS

The present invention will now be explained with reference to the accompanying drawings.

(First Embodiment)

Figure 1:
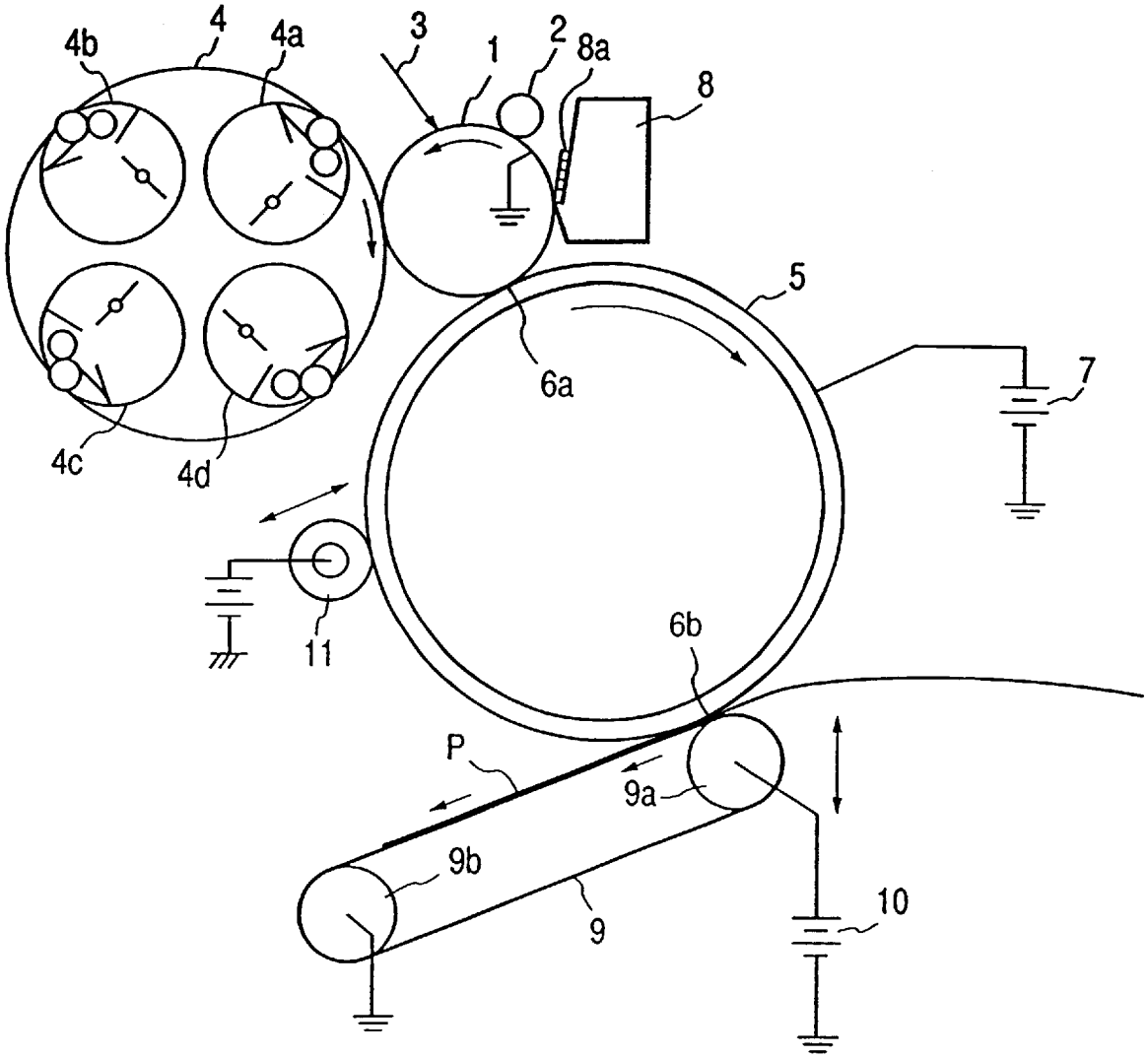
FIG. 1 is a schematic constructural view of an image forming apparatus according to a preferred embodiment of the present invention.

FIG. 1 is a schematic constructural view of an image forming apparatus according to a first embodiment of the present invention. As shown in FIG. 1, the image forming apparatus includes an intermediate transfer member (second image bearing member) 5, as well as a photosensitive drum (first image bearing member) 1.

The photosensitive drum 1 as a first image bearing member is constituted by a cylindrical aluminum substrate and a photosensitive layer made of photosensitive material such as OPC and coated on an outer peripheral surface of the cylindrical substrate. Details of the photosensitive drum 1 will be fully described later. The photosensitive drum 1 is rotated in a direction shown by the arrow at a peripheral speed of 120 mm/sec, and first of all, a surface of the photosensitive drum is uniformly charged by a charge roller 2 with −700 V (dark portion potential $V_D$). Then, scan exposure is effected by a laser beam 3 ON/OFF-controlled in response to first image information, thereby forming a first color electrostatic latent image having bright portion potential of −100 V. The electrostatic latent image thus formed is developed by a developing means 4 to form a toner image.

The developing means 4 includes a yellow developing device 4*a* containing yellow (first color) toner, a magenta developing device 4*b* containing magenta (second color) toner, a cyan developing device 4*c* containing cyan (third color) toner, and a black developing device 4*d* containing black (fourth color) toner, which developing devices are spaced apart from each other in a circumferential direction. By rotating the developing devices 4*a* to 4*d* in the circumferential direction, the desired developing device can selectively be brought to a developing position to be opposed to the photosensitive drum. As a developing method, a jumping developing method, a two-component developing method or an FEED developing method may be used, and normally, a combination of image exposure and inversion-development is used.

A first color toner image (yellow toner image) obtained by the development is transferred onto a surface of the intermediate transfer member (second image bearing member) 5 rotated in a direction shown by the arrow, at a first transfer section (first transfer portion) 6*a* opposed to the intermediate transfer member (first transferring). The intermediate transfer member 5 has a peripheral length slightly greater than a length of a transfer material P on which the toner images are to be transferred. The intermediate transfer member is rotated in a normal direction (along which a portion thereof opposed to the photosensitive drum 1 is shifted in the same direction at a peripheral speed substantially the same as a peripheral speed of the photosensitive drum) while being urged against the photosensitive drum 1 with predetermined pressure. The transferring of the toner image formed on the photosensitive drum 1 onto the transfer material is effected electrostatically by applying a voltage (first transfer bias) having a polarity opposite to a charging polarity of the toner to the intermediate transfer member 5 by means of a high voltage power source 7. After the first transferring is finished, a small amount of toner remaining on the photosensitive drum 1 is removed by a cleaning blade (elastic blade) 8*a* of a cleaning device 8.

By repeating the above process three further times, the magenta (second color) toner image developed by the developing device 4*b*, the cyan (third color) toner image developed by the developing device 4*c* and the black (fourth color) toner image developed by the developing device 4*d* are successively transferred onto the intermediate transfer member 5 in a superimposed fashion whenever the toner image is formed. Thus, four color (yellow, magenta, cyan and black) toner images are laminated on the intermediate transfer member 5, thereby obtaining a full-color image.

A transfer belt 9 is positioned in an opposed relation to the photosensitive drum 1 with respect to the intermediate transfer member 5. The transfer belt 9 is mounted on a bias roller 9*a* and a tension roller 9*b* and can be moved toward and away from the intermediate transfer member 5 by an appropriate mechanism (not shown). When a predetermined time period has elapsed after the start of the fourth color transferring (at a predetermined timing), the transfer belt 9 (which is now spaced apart from the intermediate transfer member 5) is urged against the intermediate transfer member 5 with a predetermined urging force and is rotated in a direction shown by the arrow. At the same timing, the transfer material P is inserted into a nip or a second transfer section (second transfer portion) 6*b* between the transfer belt 9 and the intermediate transfer member 5, and simultaneously, a voltage (second transfer voltage) having a polarity opposite to the charging polarity of toner is applied to the bias roller 9*a* from a high voltage power source 10, with the result that the four color toner images formed on the intermediate transfer member 5 are transferred onto the surface of the transfer material P collectively (second transferring).

The transfer material P to which the four color toner images were transferred is sent to a fixing device (not shown), where the four color toner images are fused and mixed to form a permanent full-color image on the transfer material. Thereafter, the transfer material is discharged out of the image forming apparatus. After the second transferring, a small amount of toner remaining on the intermediate transfer member 5 is removed by a cleaning device (cleaning roller) 11 by urging the cleaning device against the intermediate transfer member at a predetermined timing.

Figure 2:
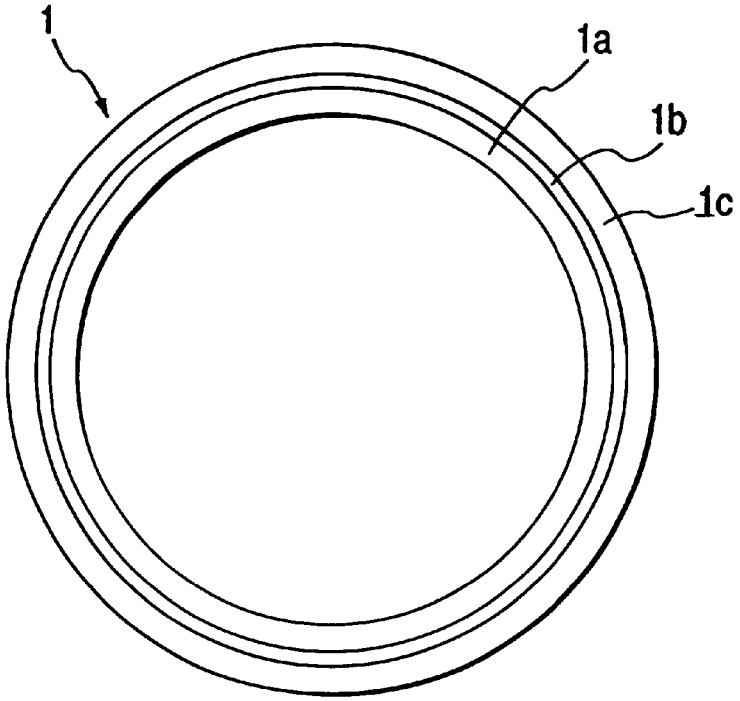
FIG. 2 is a sectional view showing a layer structure of a photosensitive drum used in the image forming apparatus of FIG. 1.

As shown in FIG. 2, the photosensitive drum 1 used in the illustrated embodiment is constituted by an aluminum core cylinder 1*a* having a diameter of about 60 mm, a charge generating layer 1*b* made of phthalocyanine compound and having a thickness of about 0.2 μm and coated on the core cylinder, and a charge transfer layer 1*c* coated on the layer 1*b* and obtained by dispersing hydrazone compound into polycarbonate (binder). The, photosensitive drum has an organic photosensitive body.

As a result of measurement of contact angle and slip (slipping ability) of the surface of the photosensitive drum 1, it was found that the contact angle is 85° and that there is no slip. The slip was measured by using a slip test machine manufactured by Haydon Inc. (Incidentally, the slip of polyethlene terephthalate (PET) is regarded as "1" and the slip of an object measured is shown as a ratio with respect to the slip of PET; the smaller the value of slip the more excellent the slip of the object.)

The toner used in the illustrated embodiment is polymerized toner manufactured by suspension polymerization, for example, and includes low soft substance of 5 to 30 weight %. Such toner is a non-magnetic toner (non-magnetic one-component developer) having a diameter of spherical particle of 5 to 7 μm and a shape coefficient (particularly, shape coefficient SF1) of 100 to 120. Preferably, a shape coefficient SF2 is 100 to 120.

Figure 3:
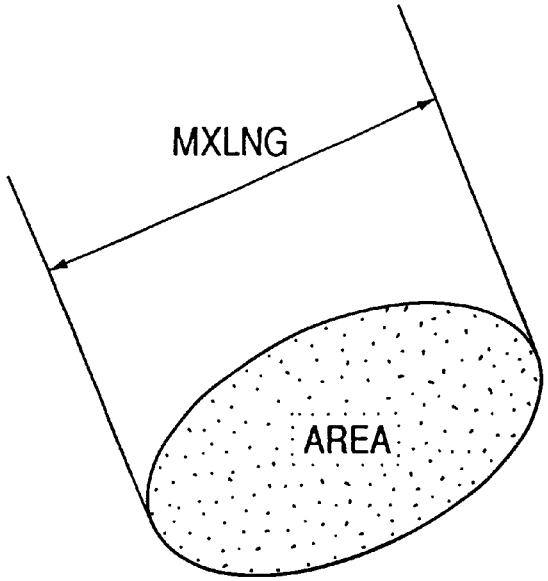
FIG. 3 is a view for explaining a shape coefficient SF1 representing a degree of roundness of toner preferably used in the present invention.

The "shape coefficient SF1" is a numerical value representing shape roundness of spherical substance, and, as shown in FIG. 3, shape coefficient SF1 is represented by a value obtained by dividing the square of a maximum length MXLNG of an ellipse formed by projecting the spherical substance onto a two-dimensional plane by an area AREA of the ellipse and multiplying it by 100/4π. That is to say, $$SF1=\{(MXLNG)^2/\text{AREA}\}\times(100/4\pi).$$

Figure 4:
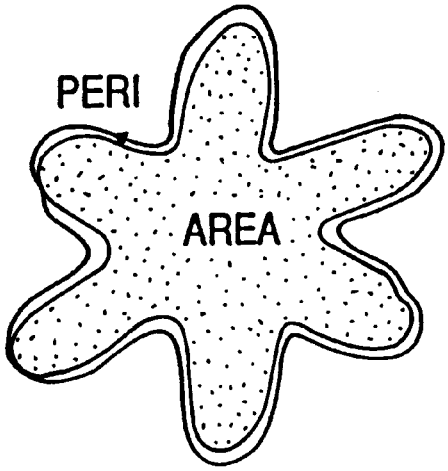
FIG. 4 is a view for explaining a shape coefficient SF2 representing a rate of unevenness of a shape of the toner preferably used in the present invention.

As shown in FIG. 4, the "shape coefficient SF2" is a numerical value representing a ratio of unevenness of a shape of substance, and is represented by a value obtained by dividing the square of a peripheral length PERI of a figure formed by projecting the substance onto a two-dimensional plane by an area AREA of the figure and multiplying it by 100/4π. That is to say, $$SF2=\{(PERI)^2/\text{AREA}\}\times(100/4\pi).$$

In the illustrated embodiment, the shape coefficients SF1, SF2 were calculated on the basis of the above equations, by sampling images of toner particles at random by 100 times by using FE-SEM (S-800) manufactured by Hitachi Seisakusho Co., Ltd. and by analyzing the image information data by introducing them into an image analyzing apparatus (LUSEX 3) manufactured by Nikore Co., Ltd through an interface.

Figure 5:
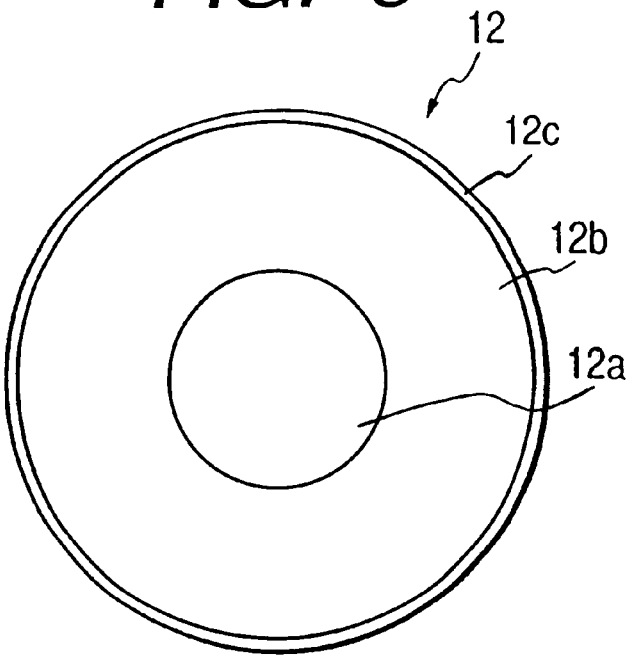
FIG. 5 is a sectional view showing a layer structure of a polymerized toner used in the present invention.

The polymerized toner used in the illustrated embodiment is schematically shown in FIG. 5. As shown in FIG. 5, the polymerized toner 12 has a substantially spherical shape due to its manufacturing method. The polymerized toner 12 has a three-layer structure including a core 12*a*, a resin layer 12*b* (on the core) and a surface layer 12*c* (on the resin layer). The core 12*a* includes wax of ester group, the resin layer 12*b* is formed from styrene-acrylate resin, and the surface layer 12*c* is formed from styrene-polyester resin. The specific weight of the toner is about 1.05.

Since the core 12*a* of the toner 12 includes wax, offset of toner in the fixing process can be prevented, and, by providing the resin surface layer 12*c*, the charging ability of the toner can be improved. Further, in order to stabilize friction charging charge amount (Q/M) of the toner 12, oil-treated silica is added to the toner 12. In this case, the friction charging charge amount of the toner 12 becomes about −20 μC/g.

Figure 6:
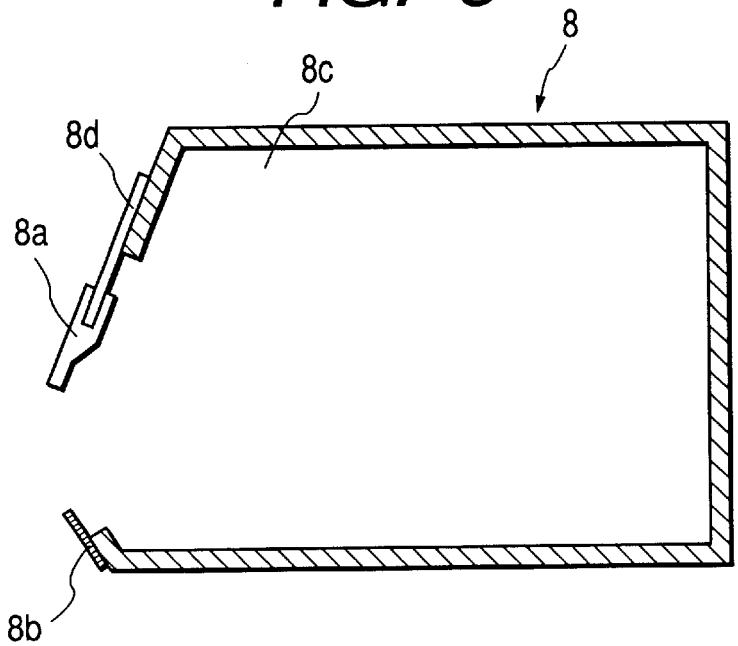
FIG. 6 is a sectional view of a cleaning device for the photosensitive drum of the image forming apparatus of FIG. 1.

Now, the cleaning device 8 used in the illustrated embodiment will be explained with reference to FIG. 6.

Figure 7:
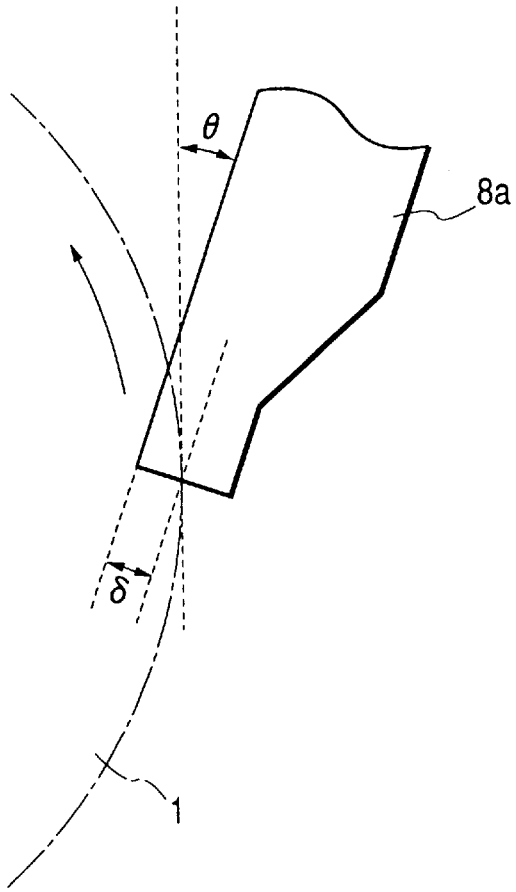
FIG. 7 is an explanatory view showing a penetration amount and a set angle of a cleaning blade of the cleaning device of FIG. 6 with respect to the photosensitive drum.

The cleaning device 8 comprises a waste toner container 8*c*, a support member 8*d* attached to a part of the container 8*c* opposed to the photosensitive drum 1, a cleaning blade (elastic blade) 8*a* supported by the support member 8*d*, and a toner collecting sheet 8*b* attached to the container 8*c* below the cleaning blade 9*a*. The cleaning blade 8*a* is formed from polyurethane rubber and is integrally held on a tip end of the support member 8*d* formed from metal sheet so that, and as shown in FIG. 7, the cleaning blade is urged against the photosensitive drum 1 from a direction (counter direction) opposite to the rotational direction of the photosensitive drum with a predetermined penetration amount δ and a predetermined set angle θ. The penetration amount δ is a penetration length of the tip end portion of the cleaning blade 8*a* when it is assumed that the tip end portion of the cleaning blade. 8*a* is not deformed and is penetrated into the photosensitive drum 1 as it is. The set angle θ is an angle between a tangential line at a point where the tip end of the blade 8*a* is contacted with the photosensitive drum 1 and a longitudinal axis of the cleaning blade 8*a*.

Figure 8:
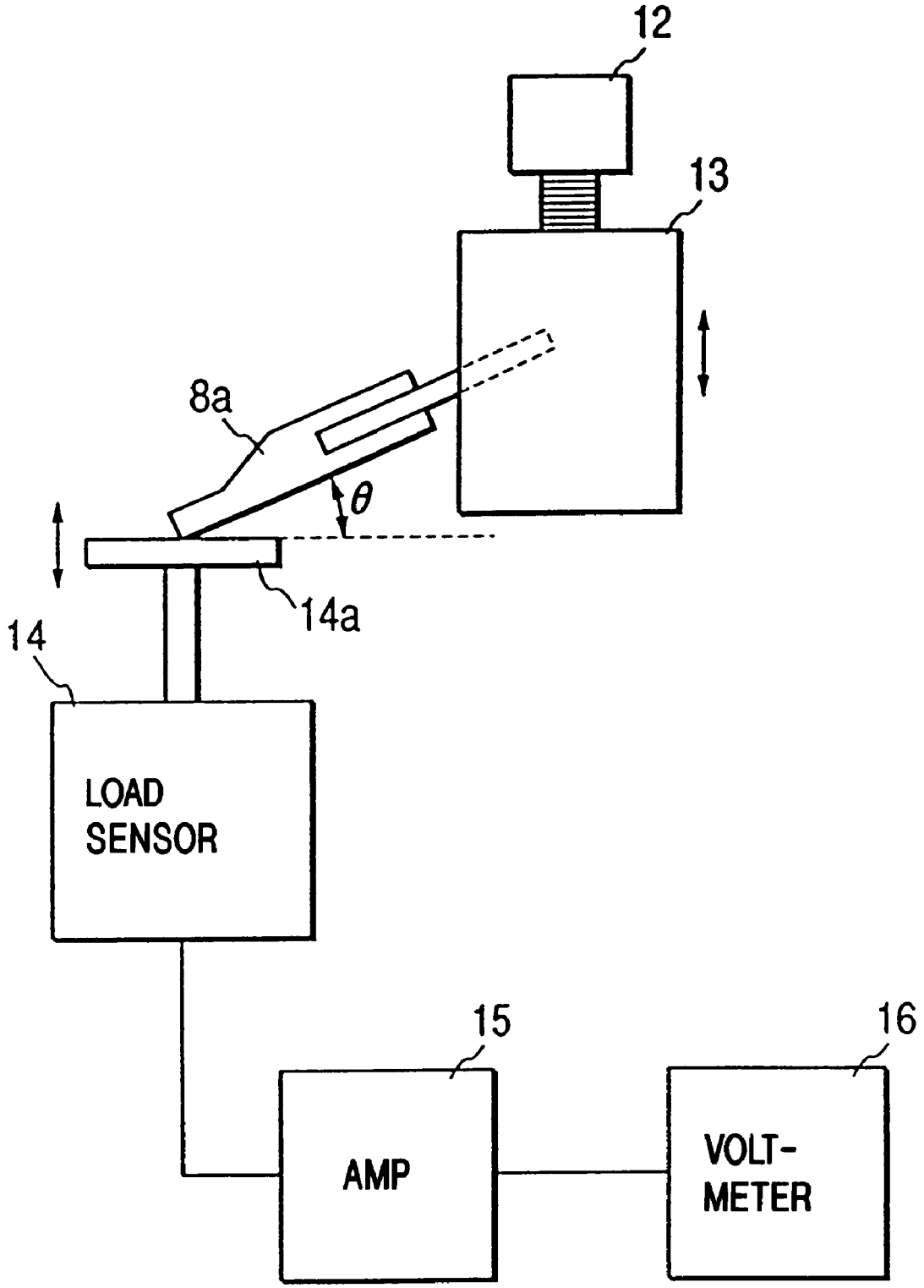
FIG. 8 is an explanatory view showing a method for measuring the penetration amount of the cleaning blade.

In the present invention, the urging pressure of the cleaning blade 8*a* against the photosensitive drum 1 is measured as shown in FIG. 8. That is to say, the cleaning blade 8*a* is cut with a width of 1 cm along a width-wise direction perpendicular to the plane of FIG. 8, and the cleaning blade 8*a* having the width of 1 cm is attached to a blade support 13 shiftable in directions shown by the double-headed arrow by a motor 12. Then, a desired set angle θ (θ=32° in the illustrated embodiment) is selected, and the tip end portion of the cleaning blade 8*a* is contacted with a receiving plate 14*a* of a load sensor 14 by lowering the blade support 13. Then, the tip end portion of the cleaning blade 8*a* is lowered by an amount corresponding to the determined penetration amount δ by lowering the blade support 13 by an amount corresponding to the determined penetration amount δ to apply pressure to the receiving plate 14*a*.

In this case, a load output value (voltage) from the load sensor 14 is amplified by an amplifier 15 and is read by a voltmeter 16. Then, by seeking a load from the load output value on the basis of a previously determined relation between the load output and a load per unit voltage, the urging pressure of the cleaning blade 8*a*, and, accordingly, line pressure of the cleaning blade 8*a* per width of 1 cm can be obtained.

The following Table 1 shows the test results performed by changing the urging pressures to judge the cleaning ability of the cleaning blades 8*a* regarding the photosensitive drum 1. In the test, three cleaning blades having different hardness were used, and, after 6000 color prints were continuously formed under a normal temperature/normal humidity environmental condition, a low temperature/low humidity environmental condition and a high temperature/high humidity environmental condition, respectively, the cleaning abilities and the like were checked. The urging pressure of the cleaning blade against the photosensitive drum was changed by changing the penetration amount δ of the cleaning blade with respect to the photosensitive drum.

TABLE 1

| | blade A (hardness 63°) | | | blade B (hardness 69°) | | | blade C (hardness 73°) | | |
|---|---|---|---|---|---|---|---|---|---|
| abut pressure (g · f/cm) | low temp./ low humidity | normal temp./ normal humidity | high temp./ high humidity | low temp./ low humidity | normal temp./ normal humidity | high temp./ high humidity | low temp./ low humidity | normal temp./ normal humidity | high temp./ high humidity |
| 50 | poor CLN | poor CLN | poor CLN | poor CLN | poor CLN | poor CLN | poor CLN | poor CLN | poor CLN |
| 55 | poor CLN | poor CLN | ○ | poor CLN | ○ | ○ | poor CLN | ○ | ○ |
| 60 | poor CLN | ○ | ○ | poor CLN | ○ | ○ | poor CLN | ○ | ○ |
| 65 | poor CLN | ○ | ○ | poor CLN | ○ | ○ | poor CLN | ○ | ○ |
| 70 | ○ | ○ | ○ | ○ | ○ | ○ | ○ | ○ | ○ |

TABLE 1-continued

| abut pressure (g · f/cm) | blade A (hardness 63°) | | | blade B (hardness 69°) | | | blade C (hardness 73°) | | |
|---|---|---|---|---|---|---|---|---|---|
| | low temp./ low humidity | normal temp./ normal humidity | high temp./ high humidity | low temp./ low humidity | normal temp./ normal humidity | high temp./ high humidity | low temp./ low humidity | normal temp./ normal humidity | high temp./ high humidity |
| 75 | ○ | ○ | ○ | ○ | ○ | ○ | ○ | ○ | ○ |
| 80 | ○ | ○ | noise | ○ | ○ | noise | ○ | ○ | noise |
| 85 | ○ | ○ | noise | ○ | ○ | noise | ○ | ○ | noise |
| 90 | ○ | ○ | noise | ○ | noise | noise | ○ | noise | noise |
| 95 | ○ | noise | noise | ○ | noise | noise | ○ | noise | noise |
| 100 | noise | noise | noise | noise | noise | noise | noise | noise | noise |

As shown in the Table 1, in the low temperature/low humidity environment, when the urging pressure is smaller than 65 g·f/cm all of the cleaning blades (A, B, C) having various hardness generate poor cleaning (CRN) as the number of prints is increased.

By observing edge portions of the cleaning blades urged against the photosensitive drum in this case in an enlarged scale, it was ascertained that the entire area of the cleaning blades is worn along the entire area in the width-wise direction. It is considered that the reason is that, since the urging pressure of the cleaning blade against the photosensitive drum is small, a small amount of toner continuously rubs the edge portion of the cleaning blade and is passed through the edge portion due to vibration during the continuous printing operation, with the result that the edge portion is gradually worn out.

On the other hand, in the high temperature/high humidity environment, when the urging pressure of the cleaning blade against the photosensitive drum is greater than 80 g·f/cm, it was found that noise is generated due to vibration of the cleaning blade.

Judging from the above results, in the illustrated embodiment, the cleaning blade 8*a* made of polyurethane rubber and having hardness of about 69° (JIS A hardness) is urged against the photosensitive drum 1 with urging pressure of about 73 g·f/cm, penetration amount δ of 1.3 mm and set angle of θ of 32°. In this condition, 6000 color prints were continuously formed under the low temperature/low humidity environment and the high temperature/high humidity environment, respectively. It was found that poor cleaning was not generated and good color images could be obtained in both the low temperature/low humidity environment and the high temperature/high humidity environment.

(Second Embodiment)

According to a second embodiment of the present invention, in the image forming apparatus according to the first embodiment shown in FIG. 1, there is provided a detection means for automatically detecting an environmental condition under which the apparatus is used, and the penetration amount of the cleaning blade with respect to the photosensitive drum can be altered or changed in accordance with the detected environmental information. Since the other arrangements of the second embodiment are the same as those of the first embodiment, an explanation thereof will be omitted, and FIG. 1 is referred, if necessary.

The following Table 2 shows test result regarding worn amounts of the photosensitive drum 1 generated by the cleaning blade 8*a*.

TABLE 2

| worn amounts | 1000 sheets | 2000 sheets | 3000 sheets | average worn amount per 1000 sheets |
|---|---|---|---|---|
| low temperature/ low humidity | 1.7 μm | 3.5 μm | 5.3 μm | 1.78 μm |
| normal temperature/ normal humidity | 2.0 μm | 4.2 μm | 6.1 μm | 2.03 μm |
| high temperature/ high humidity | 2.6 μm | 5.3 μm | 8.0 μm | 2.67 μm |

In the test, the cleaning blade made of polyurethane rubber having hardness of about 69° (JIS A hardness) was urged against the photosensitive drum with urging pressure of about 73 g·f/cm, and 3000 color prints were formed intermittently under the normal temperature/normal humidity environmental condition, the low temperature/low humidity environmental condition and the high temperature/high humidity environmental condition, respectively, and worn amounts of the surface of the photosensitive drum were measured.

As shown in the Table 2, it can be seen that the worn amount of the surface of the photosensitive drum in the high temperature/high humidity environment is greater than that in the low temperature/low humidity environment even when the urging pressure of the cleaning blade is the same. It is considered that the reason is that, as described in connection with the first embodiment, as is the same reason that noise is apt to be generated in the high temperature/high humidity environment, the slip (slipping ability) of the surface of the photosensitive drum is reduced in the high temperature/high humidity environment to increase friction between the photosensitive drum and the cleaning blade.

Thus, according to this embodiment, in the low temperature/low humidity environment where poor cleaning is apt to occur and the worn amount is small, the penetration amount of the cleaning blade with respect to the photosensitive drum is set greater to increase the urging force of the cleaning blade against the photosensitive drum. In the high temperature/high humidity environment where the noise is apt to be generated and the worn amount is great, the penetration amount of the cleaning blade is set smaller to decrease the urging force of the cleaning blade, so that the poor cleaning and the noise can be prevented and the worn amount of the photosensitive drum can be reduced under all environmental conditions from the low temperature/low humidity environment to the high temperature/high humidity environment, thereby improving the service life of the photosensitive drum.

In the illustrated embodiment, as mentioned above, there is provided the detection means for automatically detecting the environmental condition under which the apparatus is used, and, as mentioned above, the penetration amount of the cleaning blade with respect to the photosensitive drum is changed in accordance with the detected environmental information. Now, the automatic environmental condition detecting means used in this embodiment will be described.

Also in this second embodiment, as is in the first embodiment shown in FIG. 1, although the charge roller (first charge means) 2 for uniformly charging the photosensitive drum is provided, the material forming the charge roller generally has a feature that an electrical resistance value of the roller is greatly changed in dependence upon the surrounding environmental condition. That is to say, in the low temperature/low humidity environment, the resistance value of the charge roller 2 tends to increase in comparison with the high temperature/high humidity environment. Conversely, in the high temperature/high humidity environment, the resistance value of the charge roller 2 tends to decrease in comparison with the normal temperature/normal humidity environment. Thus, in the illustrated embodiment, the charge roller 2 is used as the environmental condition detecting means so that the environmental condition under which the image forming apparatus is used can be detected by detecting the resistance of the charge roller 2.

In the illustrated embodiment, when the charge roller 2 of the image forming apparatus of FIG. 1 is opposed to a non-image forming area of the photosensitive drum 1, DC bias controlled with constant current of −20 μA was applied to the charge roller 2 to check environmental dependency of the voltage generated in the charge roller 2. Test results are shown in FIG. 9.

Figure 9:
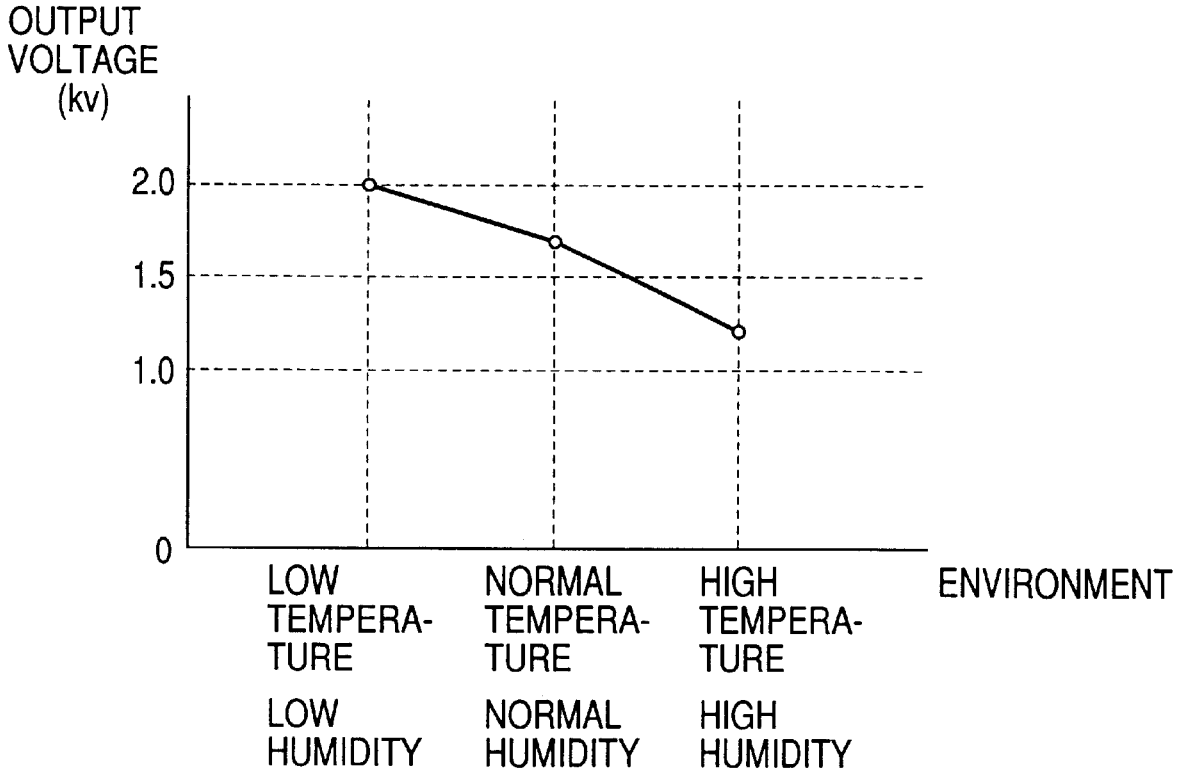
FIG. 9 is a graph showing environment dependency of resistance of a charge roller used as an environment condition detecting means in another embodiment of the present invention.

As shown in FIG. 9, the voltage generated in the charge roller 2 is −1.7 kV in the normal temperature/normal humidity environment. Whereas, in the low temperature/low humidity environment, since the resistance value of the charge roller 2 is relatively great, the generated voltage becomes relatively high such as −2.0 kV, and, in the high temperature/high humidity environment, since the resistance value of the charge roller 2 is relatively small, the generated voltage becomes relatively low such as −1.2 kV. Accordingly, in consideration of dispersion in the resistance values of the charge roller 2, by detecting whether the actually measured generated voltage is greater or smaller than the previously set voltage value, the surrounding environmental condition can be detected, and, the environmental condition information so obtained may be fed-back to set the penetration amount of the cleaning blade.

Figure 10:
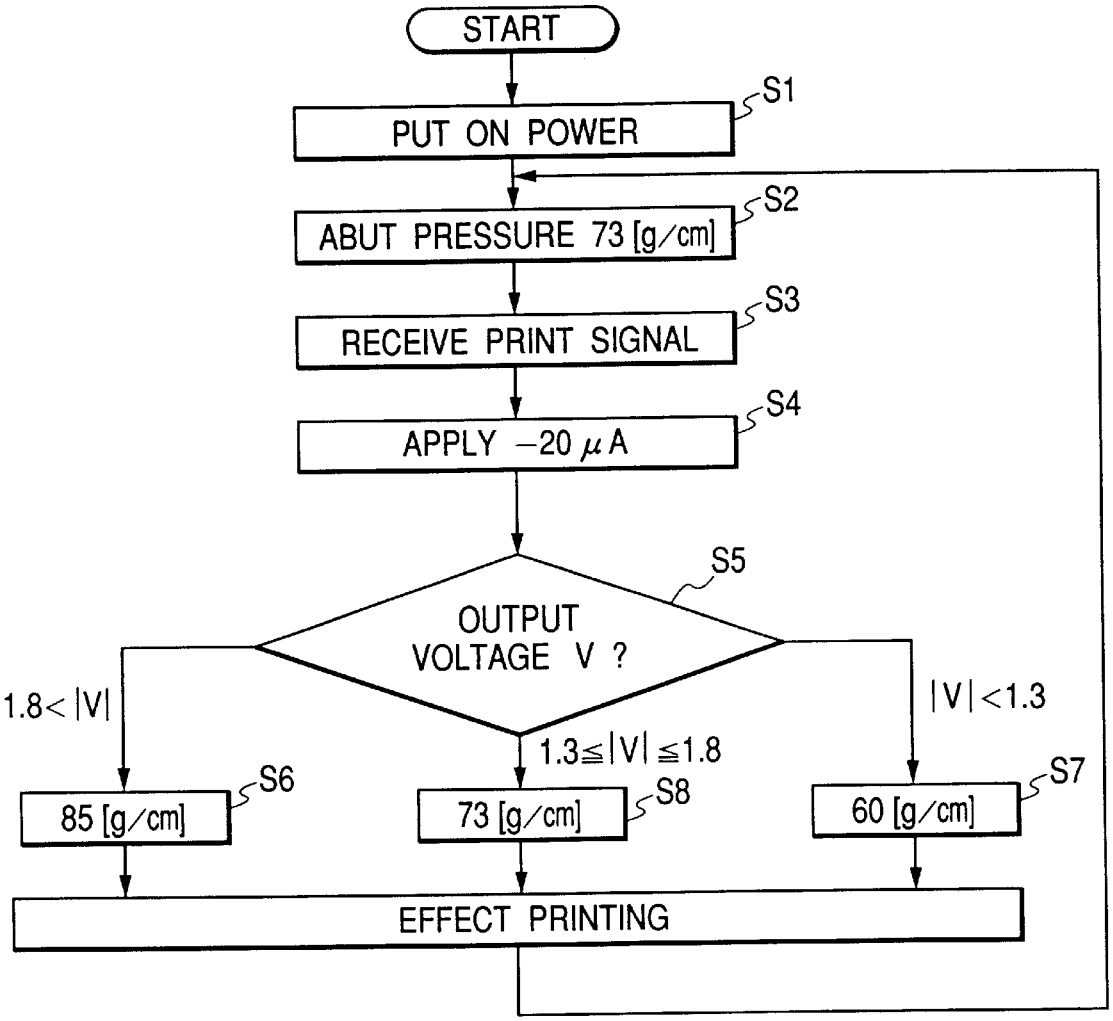
FIG. 10 is a flowchart showing a control method for controlling abut pressure of the cleaning blade on the basis of environment information detected by the environment condition detecting means.

FIG. 10 shows a flowchart for controlling the urging pressure of the cleaning blade in the illustrated embodiment. In the illustrated embodiment, in consideration of the above-mentioned test results and the dispersion in the resistance values of the charge roller 2, the output voltage value judging that the surrounding environment is a low temperature/low humidity environment is selected to −1.8 kV, and the output voltage value judging that the surrounding environment is a high temperature/high humidity environment is selected to −1.3 kV.

First of all, when a power source of the image forming apparatus is put on (step S1), the apparatus is brought to a waiting condition through a predetermined sequence. In this case, the penetration amount of the cleaning blade 8*a* with respect to the photosensitive drum 1 is set to 1.3 mm (as an initial value) to obtain the urging pressure (abut pressure) of the cleaning blade 8*a* of 73 g·f/cm (step S2). Thereafter, when a print signal is received from a host equipment (not shown) (step S3), the photosensitive drum 1 starts to be rotated. Thereafter, a DC bias controlled with constant current of −20 μA is applied to the charge roller 2 (step S4).

Then, the voltage (output voltage) generated by the application of the DC bias to the charge roller 2 is compared with predetermined threshold values (−1.8 kV and −1.3 kV) (step S5). If the generated voltage is greater than −1.8 kV, it is judged that the surrounding environment under which the image forming apparatus is situated is the low temperature/low humidity environment, and the penetration amount of the cleaning blade is set to 1.5 mm to obtain the abut pressure of the cleaning blade (with respect to the photosensitive drum) of 85 g·f/cm (step S6). On the other hand, if the generated voltage is smaller than −1.3 kV, it is judged that the surrounding environment under which the image forming apparatus is situated is the high temperature/high humidity environment. In order to suppress the worn amount of the surface of the photosensitive drum, the penetration amount of the cleaning blade is set to 1.1 mm to obtain the abut pressure of the cleaning blade (with respect to the photosensitive drum) of 60 g·f/cm (step S7).

Figure 11:
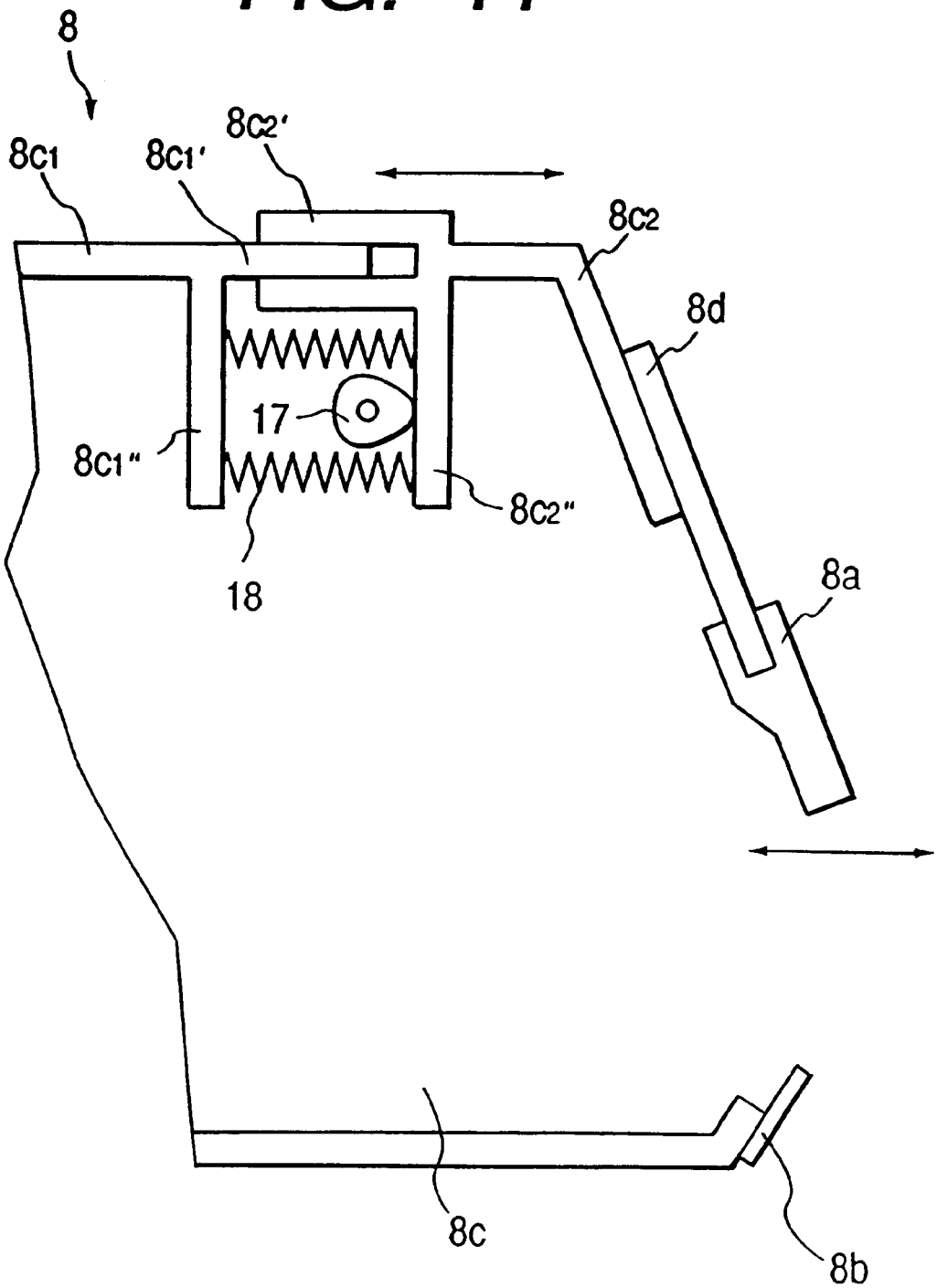
FIG. 11 is a sectional view showing a change means for changing the abut pressure of the cleaning blade.

A means for changing the urging pressure (abut pressure) of the cleaning blade may be constituted as shown in FIG. 11, for example. That is to say, in the waste toner container 8*c* of the cleaning device 8, a side part 8*c*2 of the cleaning blade 8*a* is slidably fitted onto a part 8*c*1 of the container 8*c* through telescopic parallel connections 8*c*1', 8*c*2', and two upper and lower tension springs 18 are disposed between a pair of opposed downwardly protruding portions 8*c*1", 8*c*2' formed on the part 8*c*1 of the container and the part 8*c*2 of the blade. Further, a cam 17 for urging the protruding portion 8*c*2" of the blade is disposed between the springs 18. With this arrangement, the part 8*c*2 of the blade is shifted in either the directions shown by the double-headed arrow in accordance with a rotational position of the cam 17, with the result that the cleaning blade 8*a* is also shifted accordingly, thereby changing the penetration amount (and, thus, the urging pressure) of the cleaning blade 8*a* with respect to the photosensitive drum.

As mentioned above , in the illustrated embodiment, since the urging pressure of the cleaning blade can be changed in accordance with the environmental condition under which the image forming apparatus is used, poor cleaning under the low temperature/low humidity environment can be prevented and the noise under the high temperature/high humidity environment can be prevented, thereby improving the service life of the photosensitive drum.

In the above-mentioned embodiments, while an example that the environmental condition is detected on the basis of the value of the voltage generated by applying the DC bias controlled with constant current (to the predetermined value) to the charge roller when the charge roller 2 is opposed to the non-image forming area of the photosensitive drum 1 was explained. However, the present invention is not limited to such an example, but, for example, an environmental condition may be detected on the basis of a current value required for applying DC bias controlled with constant voltage (to a predetermined value) to the charge roller.

(Third Embodiment)

According to a third embodiment of the present invention, a mold releasing layer for improving the slipping ability is provided on the surface of the photosensitive drum 1 in the first embodiment.

Figure 12:
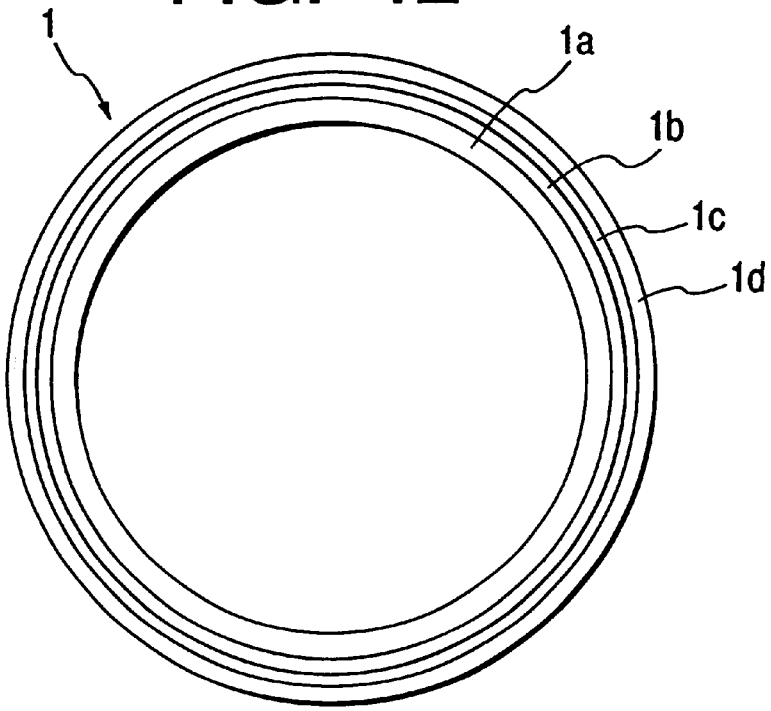
FIG. 12 is a sectional view showing a layer structure of a photosensitive drum according to a further embodiment of the present invention.

As shown in FIG. 12, a photosensitive drum 1 according to the third embodiment is constituted by an aluminum core cylinder la having an outer diameter of about 60 mm, a charge generating layer 1*b* made of phthalocyanine compound and having a thickness of 0.2 μm and coated on the core cylinder, a charge transfer layer 1*c* having a thickness of 15 μm and coated on the layer 1*b* and obtained by dispersing hydrazone compound into polycarbonate (binder), and a surface mold releasing layer 1*d* having a thickness of 4 μm and coated on the layer 1*c*. The surface mold releasing layer 1*d* includes acrylic resin (as binder) having ultraviolet ray curing ability, and Teflon (trade mark) of 35% (as fluororesin particles) having a particle diameter of about 0.3 μm and dispersed in the binder. An amount of the fluororesin particles added to the surface mold releasing layer 1d is preferably 45% at the maximum, because, if the amount is too great, the binding force of the binder will be weakened, to make the film strength of the mold releasing layer 1*d* fragile.

In this way, by providing the charge transfer layer 1*c* and the surface mold releasing layer 1*d* (for improving mold releasing ability) as the surface layer of the photosensitive drum 1, it is possible to add a relatively large amount of fluororesin particles to the surface mold releasing layer 1*d*, thereby improving the slipping ability of the surface of the photosensitive drum remarkably. Regarding the photosensitive drum (according to the illustrated embodiment) having such characteristics, as a result that contact angle and slipping ability of water with respect to the surface of the photosensitive drum were measured, it was found that the contact angle becomes 10° and the slipping ability becomes 0.4.

The following Table 3 shows the test results performed by changing the urging pressures of the cleaning blades against the photosensitive drum 1 to judge the cleaning ability. In the test, as is in the second embodiment, three cleaning blades having different hardness were used, and, after 6000 color prints were continuously formed under a normal temperature/normal humidity environmental condition, a low temperature/low humidity environmental condition and a high temperature/high humidity environmental condition, respectively, the cleaning abilities and the like were checked. The urging pressure of the cleaning blade against the photosensitive drum was similarly changed by changing the penetration amount of the cleaning blade with respect to the photosensitive drum.

direction. It is considered that the reason is that, since the urging pressure of the cleaning blade against the photosensitive drum is small, a small amount of toner continuously rubs the edge portion of the cleaning blade and is passed through the edge portion due to vibration during the continuous printing operation, with the result that the edge portion is gradually worn out. On the other hand, in the high temperature/high humidity environment, if the urging pressure of the cleaning blade against the photosensitive drum is greater than 90 g·f/cm, noise will be generated due to vibration of the cleaning blade.

Judging from the above results, in the illustrated embodiment, the cleaning blade made of polyurethane rubber and having hardness of about 69° (JIS A hardness) is urged against the photosensitive drum 1 with urging pressure of about 73 g·f/cm, penetration amount δ1.3 mm and set angle θ of 32°. In this condition, 6000 color prints were continuously formed under the low temperature/low humidity environment and the high temperature/high humidity environment, respectively. It was found that poor cleaning was not generated and good color images could be obtained in both the low temperature/low humidity environment and the high temperature/high humidity environment. By improving the slipping ability in way, the range of the urging pressure of the cleaning blade capable of preventing the inconvenience such as poor cleaning and noise is widened in comparison with the first embodiment, thereby stabilizing the performance and improving the assembling ability.

Also in this embodiment, as is in the second embodiment, since the urging pressure of the cleaning blade can be changed in accordance with the environmental condition under which the image forming apparatus is used, poor cleaning under the low temperature/low humidity environment can be prevented and the noise under the high temperature/high humidity environment can be prevented more effectively, thereby improving the service life of the photosensitive drum.

(Fourth Embodiment)

A fourth embodiment of the present invention is characterized in that the slipping ability of the surface is further improved in the third embodiment.

TABLE 3

| | blade A (hardness 63°) | | | blade B (hardness 69°) | | | blade C (hardness 73°) | | |
|---|---|---|---|---|---|---|---|---|---|
| abut pressure (g · f/cm) | low temp./ low humidity | normal temp./ normal humidity | high temp./ high humidity | low temp./ low humidity | normal temp./ normal humidity | high temp./ high humidity | low temp./ low humidity | normal temp./ normal humidity | high temp./ high humidity |
| 50 | poor CLN | poor CLN | poor CLN | poor CLN | poor CLN | poor CLN | poor CLN | poor CLN | poor CLN |
| 55 | poor CLN | poor CLN | ○ | poor CLN | ○ | ○ | poor CLN | ○ | ○ |
| 60 | poor CLN | ○ | ○ | poor CLN | ○ | ○ | poor CLN | ○ | ○ |
| 65 | ○ | ○ | ○ | ○ | ○ | ○ | ○ | ○ | ○ |
| 70 | ○ | ○ | ○ | ○ | ○ | ○ | ○ | ○ | ○ |
| 75 | ○ | ○ | ○ | ○ | ○ | ○ | ○ | ○ | ○ |
| 80 | ○ | ○ | ○ | ○ | ○ | ○ | ○ | ○ | ○ |
| 85 | ○ | ○ | ○ | ○ | ○ | ○ | ○ | ○ | ○ |
| 90 | ○ | ○ | noise | ○ | ○ | noise | ○ | ○ | noise |
| 95 | ○ | ○ | noise | ○ | noise | noise | ○ | noise | noise |
| 100 | noise | noise | noise | noise | noise | noise | noise | noise | noise |

Figure 13:
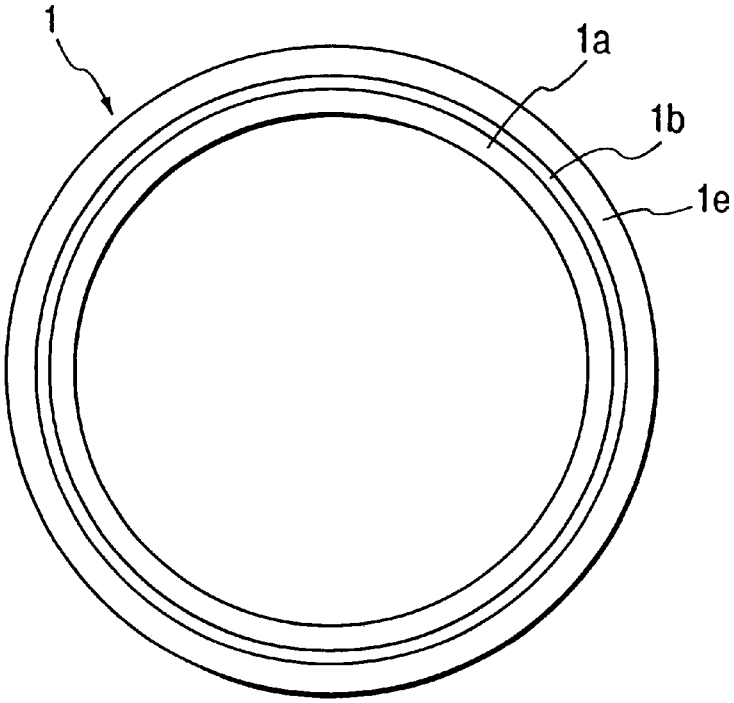
FIG. 13 is a sectional view showing a layer structure of a photosensitive drum according to a still further embodiment of the present invention.
Figure 14:
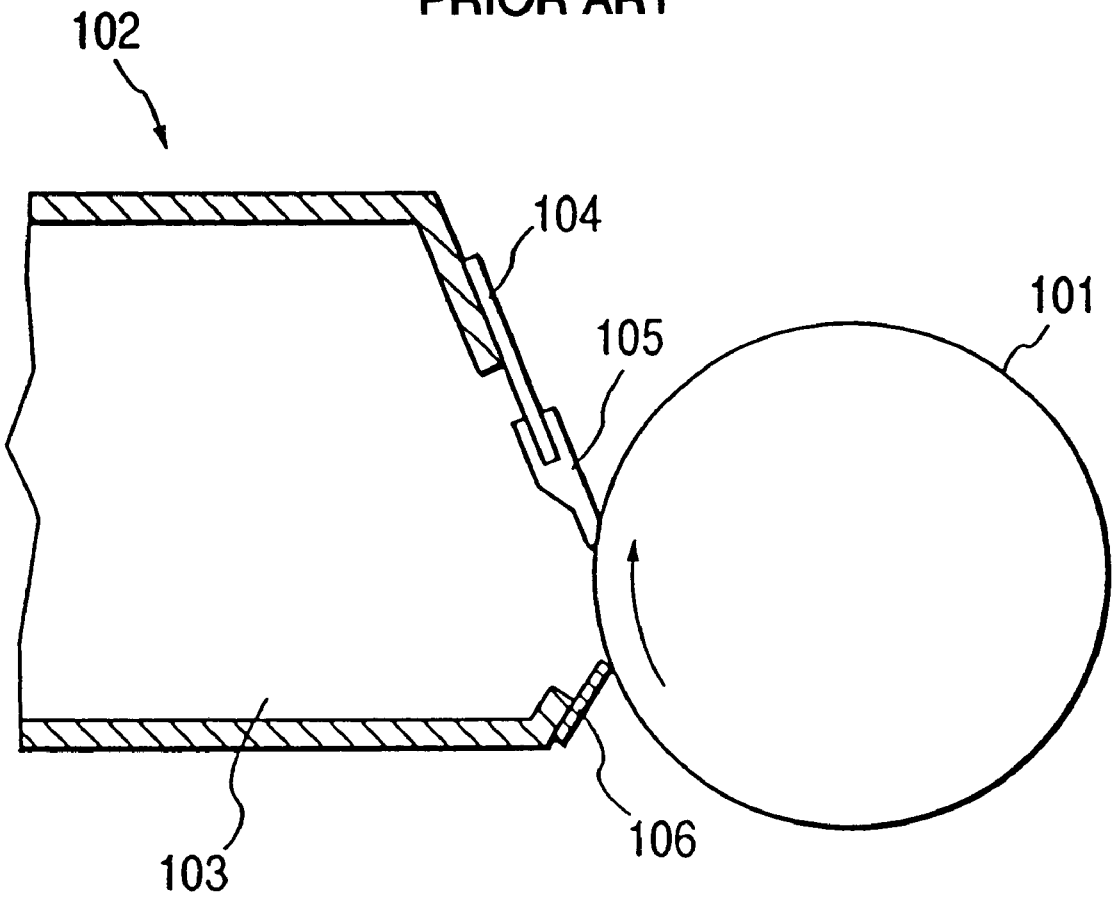
FIG. 14 PRIOR ART
FIG. 14 is a schematic sectional view of a cleaning device of a conventional image forming apparatus.

As shown in the Table 3, in the low temperature/low humidity environment, when the urging pressure (against the photosensitive drum) is smaller than 60 g·f/cm, the poor cleaning is generated as the number of prints is increased. By observing edge portions of the cleaning blades urged against the photosensitive drum in this case in an enlarged scale, it was ascertained that the entire area of the cleaning blades is worn along the entire area in the width-wise As shown in FIG. 13, a photosensitive drum 1 according to the fourth embodiment is constituted by an aluminum core cylinder 1*a* having an outer diameter of about 60 mm, a charge generating layer 1*b* made of phthalocyanine compound and having a thickness of 0.2 μm and coated on the core cylinder, and a charge transfer layer 1*e* having a thickness of 25 μm and coated on the layer 1*b* and obtained by dispersing hydrazone compound into polycarbonate (binder) and further by dispersing Teflon (trade mark) (as fluororesin particles) of 10%. An amount of the fluororesin particles to be added is preferably 20% at the maximum in order not to worsen the inherent feature of the charge transfer layer.

Regarding the photosensitive drum according to the illustrated embodiment, as a result that contact angle and slipping ability of water with respect to the surface of the photosensitive drum were measured, it was found that the contact angle becomes 95° and the slipping ability becomes 0.8.

The following Table 4 shows the test results performed by changing the urging pressures of the cleaning blades against the photosensitive drum 1 to judge the cleaning ability. As is in the above embodiments, in the test, three cleaning blades having different hardness were used, and, after 6000 color prints were continuously formed under a normal temperature/normal humidity environmental condition, a low temperature/low humidity environmental condition and a high temperature/high humidity environmental condition, respectively, by changing the abut pressures of the cleaning blades against the photosensitive drum by changing the penetration amounts of the cleaning blades with respect to the photosensitive drum, the cleaning abilities and the like were checked.

ber and having hardness of about 69° (JIS A hardness) is urged against the photosensitive drum with urging pressure of about 73 g·f/cm, penetration amount δ of 1.3 mm and set angle θ of 32°. In this condition, 6000 color prints were continuously formed under the low temperature/low humidity environment and the high temperature/high humidity environment, respectively. It was found that poor cleaning was not generated and good color images could be obtained in both the low temperature/high humidity environment and the high temperature/high humidity environment. By improving the slipping ability in this way, the range of the urging pressure of the cleaning blade capable of preventing the inconvenience such as poor cleaning and noise can be widened to 55 to 95 g·f/cm (hardness 63 to 73°) in comparison with the first and third embodiments, thereby stabilizing the performance and improving the assembling ability.

Also in this embodiment, as is in the second embodiment, since the urging pressure of the cleaning blade can be changed in accordance with the environmental condition under which the image forming apparatus is used, poor cleaning under the low temperature/low humidity environment can be prevented and the noise under the high temperature/high humidity environment can be prevented more effectively, thereby improving the service life of the photosensitive drum.

TABLE 4

| | blade A (hardness 63°) | | | blade B (hardness 69°) | | | blade C (hardness 73°) | | |
|---|---|---|---|---|---|---|---|---|---|
| abut pressure (g · f/cm) | low temp./ low humidity | normal temp./ normal humidity | high temp./ high humidity | low temp./ low humidity | normal temp./ normal humidity | high temp./ high humidity | low temp./ low humidity | normal temp./ normal humidity | high temp./ high humidity |
| 50 | poor CLN | poor CLN | ○ | poor CLN | ○ | ○ | poor CLN | ○ | ○ |
| 55 | ○ | ○ | ○ | ○ | ○ | ○ | ○ | ○ | ○ |
| 60 | ○ | ○ | ○ | ○ | ○ | ○ | ○ | ○ | ○ |
| 65 | ○ | ○ | ○ | ○ | ○ | ○ | ○ | ○ | ○ |
| 70 | ○ | ○ | ○ | ○ | ○ | ○ | ○ | ○ | ○ |
| 75 | ○ | ○ | ○ | ○ | ○ | ○ | ○ | ○ | ○ |
| 80 | ○ | ○ | ○ | ○ | ○ | ○ | ○ | ○ | ○ |
| 85 | ○ | ○ | ○ | ○ | ○ | ○ | ○ | ○ | ○ |
| 90 | ○ | ○ | ○ | ○ | ○ | ○ | ○ | ○ | ○ |
| 95 | ○ | ○ | ○ | ○ | ○ | ○ | ○ | ○ | ○ |
| 100 | ○ | ○ | noise | ○ | noise | noise | ○ | noise | noise |

As shown in the Table 4, regarding all of the cleaning blades having various hardness, when the urging pressure (against the photosensitive drum) is smaller than 50 g·f/cm, poor cleaning is generated as the number of prints is increased. By observing edge portions of the cleaning is generated as the number of prints is increased. By observing edge portions of the cleaning blades urged against the photosensitive drum in this case in an enlarged scale, it was ascertained that the entire area of the cleaning blades is worn along the entire area in the width-wise direction. It is considered that the reason is that, since the urging pressure of the cleaning blade against the photosensitive drum is small, a small amount of toner continuously rubs the edge portion of the cleaning blade and is passed through the edge portion due to vibration of the cleaning blade during the continuous printing operation, with the result that the edge portion is gradually worn out. On the other hand, if the urging pressure of the cleaning blade against the photosensitive drum is greater than 100 g·f/cm, noise will be generated due to vibration of the cleaning blade.

Judging from the above results, in the illustrated embodiment, the cleaning blade made of polyurethane rub- As mentioned above, according to the present invention, since the cleaning blade for cleaning the surface of the photosensitive drum is urged against the surface of the photosensitive drum with urging pressure of 55 to 95 g/cm, even when the non-magnetic toner including spherical particles (having the shape coefficient SF1 of 100 to 120) is used as the one-component developer, after the transferring of the toner images, the residual toner remaining on the photosensitive drum can effectively be removed without poor cleaning, noise due to vibration and great wear of the surface of the photosensitive drum.

Here, the above-mentioned advantage can be obtained, in addition to the electrophotographic photosensitive member described in the embodiments, in the intermediate transfer member. Such intermediate transfer member is shown in FIG. 1 as the transfer member 5, and known in U.S. Pat. Nos. 5,084,735 and 5,187,526. These intermediate transfer member temporarily transfers the toner image formed on the photosensitive drum, and then transfers it onto the transfer member.

What is claimed is:

1. A cleaning apparatus for cleaning a toner from a photosensitive member on which a toner image is borne, wherein the photosensitive member has a charge transport layer interspersed with fluororesin on a surface thereof, the toner is a polymeric toner and has a shape coefficient SF1 of 100 to 120 and a shape coefficient SF2 of 100 to 120, said cleaning apparatus comprising:

an elastic blade to be brought into contact with a surface of said photosensitive member to remove the toner from the surface of said photosensitive member, said elastic blade having a JIS A hardness of 63° to 73° and being urged against the surface of said photosensitive member with a line pressure of 55 to 95 g·f/cm, said elastic blade being formed so that a thickness of a portion, supported by a support member, of said elastic blade is larger than a thickness of a free end of said elastic blade.

2. A cleaning apparatus according to claim 1, wherein the toner is a nonmagnetic toner.

3. A cleaning apparatus according to claim 1, wherein said elastic blade is formed from polyurethane rubber.

4. A cleaning apparatus according to claim 1, wherein said elastic blade is urged against said photosensitive member from a counter direction with respect to a moving direction of said photosensitive member.

5. An image forming apparatus comprising:

a photosensitive member having a charge transport layer interspersed with fluororesin on a surface thereof, wherein said photosensitive member bears thereon polymeric toner having a shape coefficient SF1 of 100 to 120 and a shape coefficient SF2 of 100 to 120; and an elastic blade to be brought into contact with a surface of said photosensitive member to remove the toner from the surface of said photosensitive member, said elastic blade having a JIS A hardness of 63° to 73° and being urged against the surface of said photosensitive member with a line pressure of 55 to 95 g·f/cm, said elastic blade being formed so that a thickness of a portion supported by a support member, of said elastic blade is larger than a thickness of a free end of said elastic blade.

6. An image forming apparatus according to claim 5, wherein the toner is a nonmagnetic toner.

7. An image forming apparatus according to claim 5, wherein said elastic blade is formed from polyurethane rubber.

8. An image forming apparatus according to claim 5, wherein said elastic blade is urged against said photosensitive member from a counter direction with respect to a moving direction of said photosensitive member.

9. An image forming apparatus according to claim 5, further comprising a charging member to be brought into contact with said photosensitive member to charge said photosensitive member.

10. A cleaning apparatus for cleaning a toner from a photosensitive member on which a toner image is borne, wherein the photosensitive member has a charge transport layer on a surface thereof, the toner is a polymeric toner and has a shape coefficient SF1 of 100 to 120 and a shape coefficient SF2 of 100 to 120, said cleaning apparatus comprising:

an elastic blade to be brought into contact with a surface of said photosensitive member to remove the toner from the surface of said photosensitive member, said elastic blade having a JIS A hardness of 63° to 73° and being urged against the surface of said photosensitive member with a line pressure of 70 to 75 g·f/cm, said elastic blade being formed so that a thickness of a portion, supported by a support member, of said elastic blade is larger than a thickness of a free end of said elastic blade.

11. A cleaning apparatus according to claim 10, wherein the toner is a nonmagnetic toner.

12. A cleaning apparatus according to claim 10, wherein said elastic blade is formed from polyurethane rubber.

13. A cleaning apparatus according to claim 10, wherein said elastic blade is urged against said photosensitive member from a counter direction with respect to a moving direction of said photosensitive member.

14. An image forming apparatus comprising:

a photosensitive member having a charge transport layer on a surface thereof, wherein said photosensitive member bears polymeric toner having a shape coefficient SF1 of 100 to 120 and a shape coefficient SF2 of 100 to 120; and an elastic blade to be brought into contact with a surface of said photosensitive member to remove the toner from the surface of said photosensitive member, said elastic blade having a JIS A hardness of 63° to 73° and being urged against the surface of said photosensitive member with a line pressure of 70 to 75 g·f/cm, said elastic blade being formed so that a thickness of a portion, supported by a support member, of said elastic blade is larger than a thickness of a free end of said elastic blade.

15. An image forming apparatus according to claims 14, wherein the toner is a nonmagnetic toner.

16. An image forming apparatus according to claim 14, wherein said elastic blade is formed from polyurethane rubber.

17. An image forming apparatus according to claim 14, wherein said elastic blade is urged against said photosensitive member from a counter direction with respect to a moving direction of said photosensitive member.

18. An image forming apparatus according to claim 14, further comprising a charging member to be brought into contact with said photosensitive member to charge said photosensitive member.

19. A cleaning apparatus for cleaning a toner from a photosensitive member on which a toner image is borne, wherein the photosensitive member has a charge transport layer and a surface layer, containing fluororesin, laid on said charge transport layer, the toner is a polymeric toner and has a shape coefficient SF1 of 100 to 120 and a shape coefficient SF2 of 100 to 120, said cleaning apparatus comprising:

an elastic blade to be brought into contact with a surface of said photosensitive member to remove the toner from the surface of said photosensitive member, said elastic blade having a JIS A hardness of 63° to 73° and being urged against the surface of said photosensitive member with a line pressure of 65 to 85 g·f/cm, said elastic blade being formed so that a thickness of a portion, supported by a support member, of said elastic blade is larger than a thickness of a free end of said elastic blade.

20. A cleaning apparatus according to claim 19, wherein the toner is a nonmagnetic toner.

21. A cleaning apparatus according to claim 19, wherein said elastic blade is formed from polyurethane rubber.

22. A cleaning apparatus according to claim 19, wherein said elastic blade is urged against said photosensitive member from a counter direction with respect to a moving direction of said photosensitive member.

23. An image forming apparatus comprising:

a photosensitive member having a charge transport layer and a surface layer, containing fluororesin, laid on said charge transport layer, wherein said photosensitive member bears polymeric toner having a shape coefficient SF1 of 100 to 120 and a shape coefficient SF2 of 100 to 120; and an elastic blade to be brought into contact with a surface of said photosensitive member to remove the toner from the surface of said photosensitive member, said elastic blade having a JIS A hardness of 63° to 73° and being urged against the surface of said photosensitive member with a line pressure of 65 to 85 g·f/cm, said elastic blade being formed so that a thickness of a portion, supported by a support member, of said elastic blade is larger than a thickness of a free end of said elastic blade.

24. An image forming apparatus according to claim 23, wherein the toner is a nonmagnetic toner.

25. An image forming apparatus according to claim 23, wherein the said elastic blade is formed from polyurethane rubber.

26. An image forming apparatus according to claim 23, wherein said elastic blade is urged against said photosensitive member from a counter direction with respect to a moving direction of said photosensitive member.

27. An image forming apparatus according to claim 23, further comprising a charging member to be brought into contact with said photosensitive member to charge said photosensitive member.

* * * * *

UNITED STATES PATENT AND TRADEMARK OFFICE

CERTIFICATE OF CORRECTION

PATENT NO. : 6,393,250 B1
DATED : May 21, 2002
INVENTOR(S) : Shinichiro Tsukida et al.

It is certified that error appears in the above-identified patent and that said Letters Patent is hereby corrected as shown below:

Column 1,
Line 66, "occurring" should read -- the occurrence of --.

Column 12,
Line 15, "δ1.3 mm" should read -- δ of 1.3 mm --; and
Line 22, "in way" should read -- in this way --.

Column 49,
Line 49, "95 g/cm," should read -- 95 g·f/cm, --.

Signed and Sealed this

Twenty-second Day of October, 2002

*Attest:*

*Attesting Officer*

JAMES E. ROGAN
*Director of the United States Patent and Trademark Office*